United States Patent [19]

Young

[11] Patent Number: 4,834,444

[45] Date of Patent: May 30, 1989

[54] CARRIER FOR GOLF CLUBS OR THE LIKE

[76] Inventor: Michael R. Young, c/o Bristol Compressors, 649 Industrial Park Rd., Bristol, Va. 24201

[21] Appl. No.: 169,445

[22] Filed: Mar. 17, 1988

[51] Int. Cl.[4] ..... A63B 55/02; A63B 55/04

[52] U.S. Cl. ..... 294/143; 294/146; 294/159; 248/96; 248/156; 211/70.2; 206/315.2

[58] Field of Search ..... 211/70.2, 70.8; 248/96, 248/156, 530; 294/19.2, 143, 146, 159, 160, 162, 163; 16/110.5; 206/315.5, 315.6, 315.7, 315.8, 315.9, 315.11, 315.2

[56] References Cited

U.S. PATENT DOCUMENTS

| | | | |
|---|---|---|---|
| 1,596,231 | 8/1926 | Bennett | 248/96 |
| 2,465,096 | 3/1949 | Hunt | 294/146 X |
| 2,950,748 | 8/1960 | Olinghouse | 206/315.9 X |
| 3,483,996 | 12/1969 | Scammon | 294/143 |
| 3,966,051 | 6/1976 | Hollister et al. | 294/143 X |
| 4,154,274 | 5/1979 | Adamson | 294/159 X |

FOREIGN PATENT DOCUMENTS

| | | | |
|---|---|---|---|
| 182698 | 7/1922 | United Kingdom | 206/315.6 |

*Primary Examiner*—Johnny D. Cherry
*Assistant Examiner*—Dean Kramer

[57] ABSTRACT

A carrier for golf clubs or the like adapted for substantially upright positioning on the ground, comprising a support, a plurality of tubular holders held in fixed substantially parallel, juxtaposed relationship by the support with the bottom ends thereof lying substantially in the same plane which is oriented substantially normal to the longitudinal axes of the holders, a floor affixed to the bottom ends of the holders, and one or more spikes on the carrier adjacent the floor and extending substantially axially, outwardly therefrom.

8 Claims, 2 Drawing Sheets

CARRIER FOR GOLF CLUBS OR THE LIKE

This invention concerns carrying devices for golf clubs and golfing paraphernalia, or for other such elongated articles as croquet mallets or the like, and particularly concerns such a device having novel means by which it can quickly and easily be positioned substantially upright on the ground, in secure but easily removable attachment thereto.

Present day golfing typically involves the transportation of heavy golf bags by means of electric carts, hand pulled carts or caddies. Except for the caddies however, some pathway or the like must be available for the cart which rules out the use, for example, of many of the short cuts through perhaps somewhat difficult terrain. Moreover, it is frequently the case that a golfer wishes to play a more casual or extemporaneous round, perhaps just a few holes, and thus has no desire for carts or caddies. In such an event, the golfer may wish to use a reduced number of clubs in a light bag which can be carried without onerous physical effort and in areas which would be difficult for carts to traverse. Even the use of such a light bag has its drawbacks however, one of which is that the bag usually has to be placed (more often tossed) on the ground after a club has been selected. This often results in the club heads being banged around with each other or the ground and becoming damaged or at least scratched up. Also, the club heads or head covers and the bag quite frequently will become soaked and coated by wet grass, leaves, twigs and other flora of the course. In addition, bending over to pick the bag up can also, for some people, be a bothersome task.

A principal object therefore of the present invention is provide a carrying device, particularly adapted to carrying golf clubs and golfing equipment, wherein the device has minimum weight, is easy to handle and carry, particularly over difficult terrain, and can be readily positioned and secured to the ground in upright position whereby the clubs, balls, tees, or the like are off the ground and highly accessible.

This and other objects hereinafter appearing have been attained in accordance with the present invention through the structure of a carrying device defined as a carrier for golf clubs or the like adapted for substantially upright positioning on the ground, comprising support means, a plurality of tubular holders held in fixed substantially parallel, juxtaposed relationship by said support means with the bottom ends thereof lying substantially in the same plane which is oriented substantially normal to the longitudinal axes of said members, floor means affixed to said bottom ends, said spike means on said carrier adjacent said floor means extending substantially axially, outwardly therefrom.

The invention will be further understood from the following description and drawings wherein.

Figure 1:
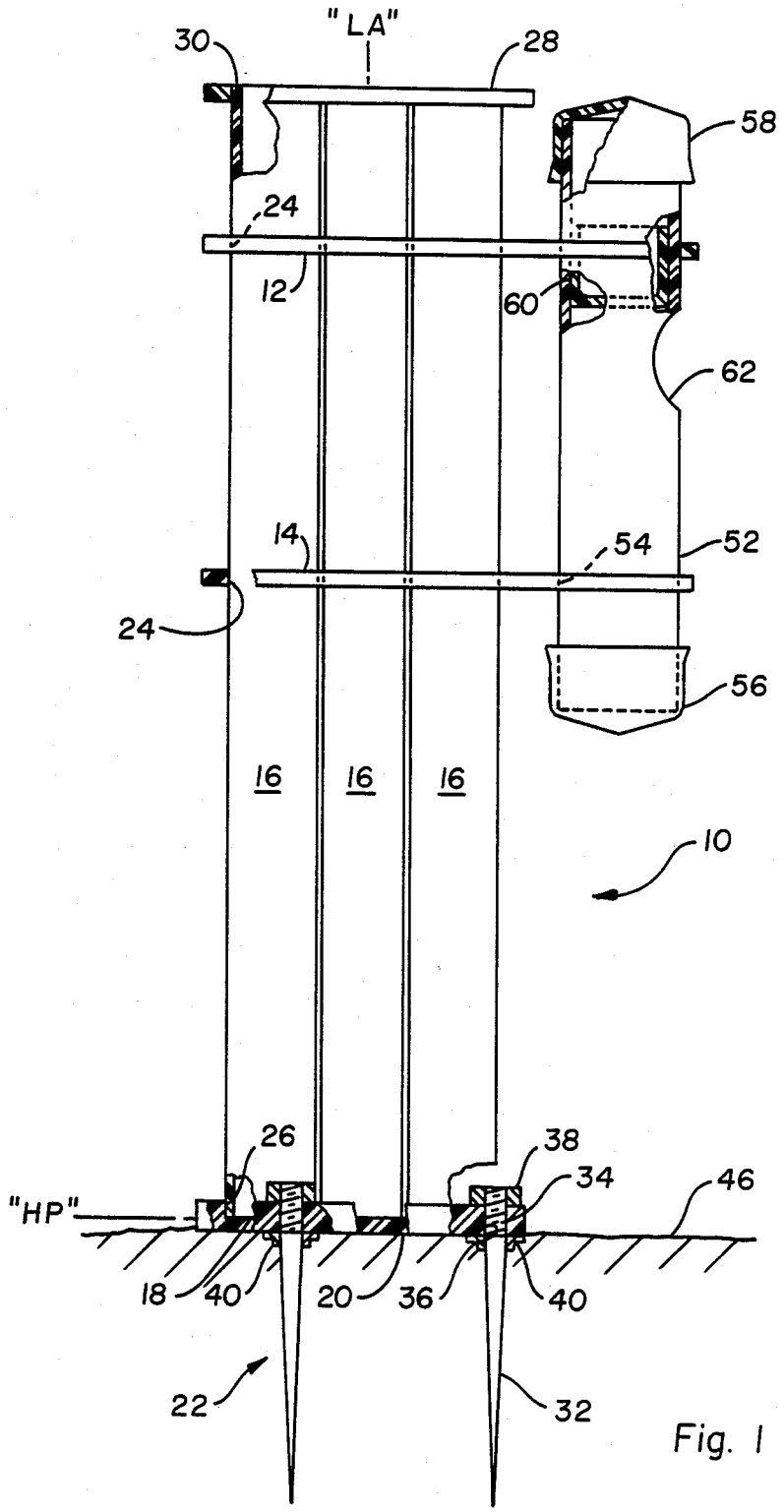
FIG. 1 is a side view, partially in section, of the carrier in upright operative position removably secured to the ground.

Referring to the drawings wherein certain structures are shown in enlarged dimensions for purposes of clarity, and with particular reference to the above description, the carrier generally designated 10 comprises supports means 12 and 14, a plurality of tubular holders 16 held in fixed substantially parallel, juxtaposed relationship by said support means with the bottom ends 18 thereof lying substantially in the same plane "HP", oriented substantially normal to the longitudinal axes "LA" of said holders, floor means 20 affixed to said bottom ends, and spike means 22 on said carrier adjacent said floor means extending substantially axially, outwardly therefrom.

Holders 16 are preferably formed of thin walled (e.g., 0.022 in.) plastic tubing of polyolefin, polyester, polycarbonate, polyamide, cellulose ester or the like having an outside diameter preferably of about 1.25 in. and a length preferably of about 32 in. These dimensions may, of course, be varied. In the embodiment shown, seven holders are provided and are secured either by friction or suitable glue, volatile solvent fusion, cement, heat fusion, mechanical means or the like in apertures 24 in the supports 12 and 14 which are comprised of material such as employed for the holders. More or fewer holders may of course be employed.

The bottom ends 18 of the holders are secured to the floor 20, preferably by means of recesses 26 formed in the floor and tightly receiving ends 18 which, as for the holders and supports, can be cemented or otherwise joined together. The top ends of the holders may, but not of necessity, lie in the same plane and be provided with a top plate 28 having apertures 30 or recesses such as 26 in which the tube ends are secured as decsribed above.

Figure 5:
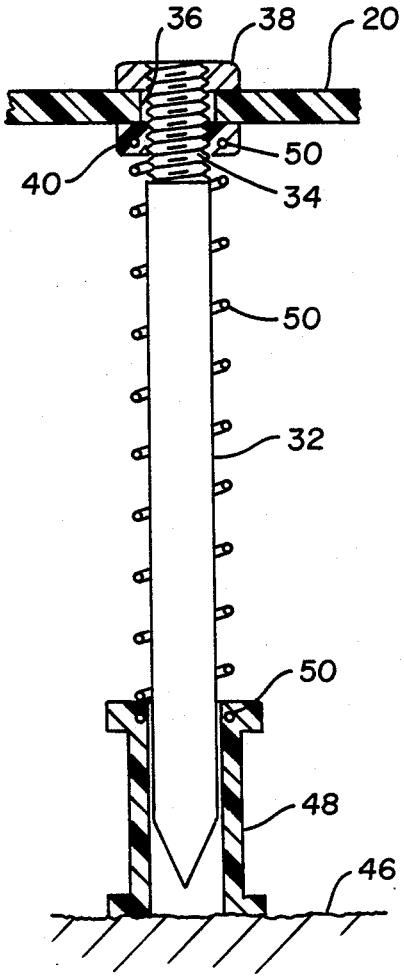
FIG. 5 is a partially cross-sectioned view of another embodiment of the spike structure with a variation of the protector in place.
Figure 4:
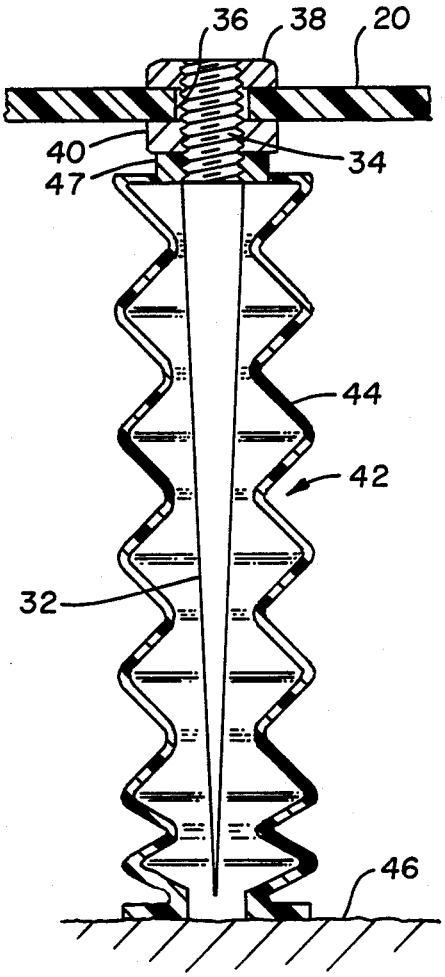
FIG. 4 is a partially cross-sectioned view of an alternative spike structure with protector in place.

The spike means, generally designated 22 is preferably of steel, aluminum, stainless steel, or brass, but which also may be reinforced plastic or the like, and each thereof preferably comprises a tapered tip 32 of about 2 in. in length, and a threaded shank 34 of about ¾ in. in length and of about 0.188 in. diameter. Here again, these dimensions are exemplary of a working embodiment of the present invention, and may be varied within fairly wide limits. The spikes are secured to the carrier by any suitable means, as in the embodiment illustrated in FIG. 1 by means of threading the shanks 34 thereof into threaded apertures 36 in floor 20. Nuts 38 threaded onto shanks 34 above the floor assist in locking the spikes thereto. Washers 40 may be provided on the spikes by press-fitting, staking or the like to assist in locking the spikes to the floor as well as to provide a means for limiting the threading of the spike up through the floor. Alternatively, elements 40 may be nuts, which may comprise the speed nut type, provided on the shank below floor 20, as shown in FIGS. 4 and 5. Aperture means such as 41 can be formed in the floor to provide for water drainage from the holders 16.

Referring to FIG. 4, protector means generally designated 42 is provided to protect against accidental contact with the point of the spike, and comprises, in this preferred embodiment, an elongated, resilient, axially collapsible sleeve 44, preferably of elastomeric or other such rubbery resilient material which, upon forcible contact with the ground 46 will compress or collapse to a fraction of its normal length to thereby expose and allow ground penetration of a major portion of the spike tip. A convenient attachment means for this protector comprises the upper heavier portion 47 thereof in the form of a nut for threading onto shank 34.

A variation of the spike and protector means is shown in FIG. 5 wherein the spike is essentially non-tapered except at the very end thereof which is pointed, and a plastic or metal sleeve 48 is loosely slidably mounted on the spike and is normally urged to the elongated position shown by means of a light compression spring 50 to cover the sharp end of the spike. The ends of spring 50 are conveniently imbedded in the plastic sleeve and nut 40 as shown, to provide a unitary structure allowing easy connection to the floor 20 simply by threading nut 40 onto shank 34 before or after inserting the shank through aperture 36.

It is noted that the spikes, including the embodiments shown in FIGS. 4 and 5, can be mounted on other portions of the carrier than floor 20. For example, suitable brackets equivalent to the floor segments shown, for supporting the spikes could be located on the exterior walls of holders 16. Also, the spikes themselves could be made retractable for safety, such that they could be extended to operable position when needed, however; the embodiments shown are preferred.

Figure 2:
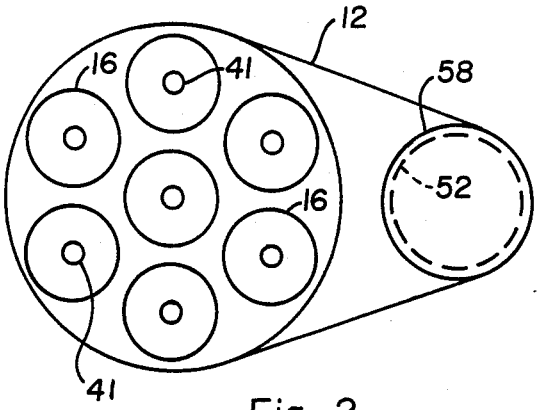
FIG. 2 is a top view of the carrier.
Figure 3:
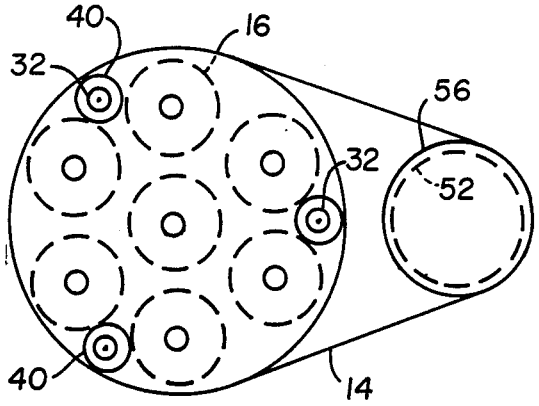
FIG. 3 is a bottom view of the carrier.

Referring further to FIGS. 1–3 tubular handle means 52 is affixed in suitable apertures 54 in supports 12 and 14 by glue or the like as aforesaid, and has a diameter sufficient to receive golf balls. Easily removably bottom and top caps 56 and 58 of similar construction are provided and retained on the handle by friction, cap 56 allowing removal of the golf balls as needed, and cap 58 allowing for either filling the handle with balls or for provided access to golf tees which may be contained in a cup-shaped insert 60 frictionally or otherwise secured in the handle. Where such insert is employed, suitable aperture means 62 in the handle wall may be provided for entering the golf balls into the handle.

The invention has been described in detail with particular reference to preferred embodiments thereof, but it will be understood that variations and modifications will be effected within the spirit and scope of the invention.

I claim:

1. A carrier for golf clubs or the like adapted for substantially upright positioning on the ground, comprising support means, a plurality of tubular holders held in fixed substantially parallel, juxtaposed relationship by said support means with the bottom ends thereof lying substantially in the same plane which is oriented substantially normal to the longitudinal axes of said holders, tubular handle means mounted on said support means and extending generally axially of said tubular holders, the bottom and top of said handle means being provided with removable cap means, floor means affixed to said bottom ends, and spike means on said carrier adjacent said floor means extending substantially axially, outwardly therefrom.

2. The carrier of claim 1 wherein said spike means comprises a plurality of spikes affixed to said floor means adjacent the periphery thereof and spaced substantially equidistantly therearound.

3. The carrier of claim 1 wherein longitudinally compressible, normally elongated protector means is provided on said spike means.

4. The carrier claim 3 wherein said protector means comprises a normally elongated, resilient, axially collapsible sleeve dimensioned with respect to said spike means to extend beyond the end thereof in its said normally elongated condition.

5. The carrier of claim 1 wherein divider means is provided within said handle means to divide the same into separate tubular, upper and lower compartments.

6. The carrier of claim 5 wherein said divider means comprises a generally cup shaped insert frictionally removably held in position within said handle means against the inner tubular wall thereof.

7. The carrier of claim 5 wherein said handle means has an internal diameter larger than that of a golf ball, and wherein aperture means is provided in said tubular wall of said handle means below said divider means of sufficient size to permit the insertion of golf balls therethrough into said lower compartment.

8. The carrier of claim 6 wherein said handle means has an internal diameter larger than that of a golf ball, and wherein aperture means is provided in said tubular wall of said handle means below said divider means, of sufficient size to permit the insertion of golf balls therethrough into said lower compartment.

* * * * *